United States Patent [19]

Grujanac et al.

[11] Patent Number: 4,813,849

[45] Date of Patent: Mar. 21, 1989

[54] FLUID PUMP WITH AIR INDUCER

[75] Inventors: Peter Grujanac, Bartlett; Robert W. Johnson, Elgin, both of Ill.

[73] Assignee: Lakeside Equipment, Bartlett, Ill.

[21] Appl. No.: 76,533

[22] Filed: Jul. 22, 1987

[51] Int. Cl.[4] ..... F04D 3/00

[52] U.S. Cl. ..... 416/177; 415/72; 366/156; 261/86

[58] Field of Search ..... 415/71, 72, 73, 74, 415/75; 416/176, 177; 366/156, 164, 324; 261/86

[56] References Cited

U.S. PATENT DOCUMENTS

| | | | |
|---|---|---|---|
| 1,085,949 | 2/1914 | Snyder | 416/177 |
| 1,196,696 | 8/1916 | Jones | 416/177 |
| 3,077,932 | 2/1963 | Gehrke | 415/72 |
| 3,689,182 | 9/1972 | Kovacs | 416/177 |
| 4,003,672 | 1/1977 | Gamell | 416/177 |
| 4,019,830 | 4/1977 | Reid | 416/177 |
| 4,156,392 | 5/1979 | Bayeh | 415/72 |
| 4,284,503 | 8/1981 | Stahler | 261/86 |
| 4,448,685 | 5/1984 | Malina | 416/177 |

*Primary Examiner*—Robert E. Garrett
*Assistant Examiner*—John T. Kwon
*Attorney, Agent, or Firm*—Wood, Dalton, Phillips, Mason & Rowe

[57] ABSTRACT

A screw-type fluid pump is provided with an elongate casing having a surface defining an internal fluid flow space and a screw within the flow path, fixed to the casing, and having a plurality of flights for continuously conveying fluid from an inlet on the casing to an outlet for appropriate disposition as the screw and casing are rotated. A conduit/torque tube extends through the screw in axially overlapping relationship with the casing over no more than one third the axial extent of the screw at the upper region of the casing. The conduit/torque tube establishes communication between a plurality of pockets between screw turns and the atmosphere to effect pressure equalization so that cavitation in the fluid flow space is prevented as the screw is operated. The conduit/torque tube also transmits the force from a rotary drive to the screw.

6 Claims, 3 Drawing Sheets

FLUID PUMP WITH AIR INDUCER

BACKGROUND OF THE INVENTION

1. Field of the Invention

This invention relates to fluid pumps and, more particularly, to an Archimedean screw-type pump.

2. Background Art

It is known to use an Archimedean screw-type pump to convey fluids and, in one application, to hoist water from a reservoir in a waste treatment facility. The pump has a cylindrical casing defining a fluid conveying space within which a coaxially arranged, rotatable, broad-threaded screw or spirally bent tube is fixed. The casing has open inlet and outlet ends, with the latter situated above the maximum anticipated height of the water to be pumped. In operation, the pump inlet is dipped into the liquid to be elevated with the pump casing inclined at less than 90° to horizontal. As the screw and tube are rotated, the screw flights hoist water progressively upwardly and towards the outlet where it spills over and is suitably collected.

An exemplary prior art lift is shown in U.S. Pat. No. 3,077,932, to Gehrke. Gehrke discloses a spiral lift for use in oil recovery operations. One problem inherent in the Gehrke structure is that with the pump inlet submerged there is a tendency of the screw to cavitate i.e. to evacuate the space above the level of the oil supply and create air pockets in the oil that is being conveyed. This results in reduction in pump delivery capacity and potentially a backflow of oil from the upper screw flights.

One solution to the cavitation problem is proposed in U.S. Pat. No. 1,085,949, to Snyder. In Snyder, a cylindrical core is provided substantially along the entire length of a hoisting screw. The core has a hollow center which communicates with the atmosphere and a helical vent to equalize pressure in the pump by establishing communication between the inside of the core and the spaces between adjacent screw turns. Development of low pressure areas between any of the screw turns is thereby alleged to be prevented by Snyder.

There are inherent drawbacks with the Snyder structure. First, the slotted core has no structural utility other than to establish a communication path between the atmosphere and the air spaces between the screw turns. The core takes up space on the surface of the screw flights that otherwise would be useable to convey fluid. Further, the continuous spiral slot compromises the integrity of the core and the attached screw. Still further, the requirement of the vent throughout the entire length of the core complicates manufacture of the Snyder screw pump.

Summary of the Invention

The present invention is specifically directed to overcoming the above enumerated problems in a novel and simple manner.

According to the invention, a screw-type fluid pump is provided with an elongate casing having a surface defining an internal fluid flow space and a screw, within the flow space, fixed to the casing, and having a plurality of flights for continuously conveying fluid from an inlet on the casing to an outlet for appropriate disposition as the screw and casing are rotated. A conduit extends through the screw in axially overlapping relationship with the casing over no more than one half the axial extent of the screw at the upper region of the casing. The conduit defines a vent path that communicates between a plurality of pockets between screw turns and the atmosphere to effect pressure equalization so that cavitation in the fluid flow space is prevented as the screw and casing are rotated.

Because the conduit extends along no more than one-half of the length of the screw and preferably along about one-third of the screw length, incorporation of the conduit into the screw is facilitated.

In a preferred form, the conduit is a cylindrical tube and is coaxial with the casing surface defining the fluid flow space. Apertures are provided in the wall of the conduit tube for each pocket in a quantity sufficient to provide a sufficient amount of ventilation.

The apertures are sufficiently small that they do not compromise the integrity of the conduit tube. Accordingly, another aspect of the invention is the use of the conduit tube as a torque tube to provide the transmission link between a rotary drive and the screw. The conduit/torque tube thus serves the dual purpose of equalizing pressure between the pockets between screw turns and the atmosphere and transmitting a drive force to the screw. Thus a complicated connection between a drive and the screw such as that in the Snyder patent is unnecessary.

Another aspect of the invention is the extension of a surface of the conduit/torque tube axially beyond the outlet end of the casing so that it is exposed to the atmosphere. Communication between the atmosphere and vent path in the conduit/torque tube can be established by simply providing a radially directed aperture through the exposed conduit/torque tube wall. This obviates the need to provide air passage openings in the screw flights such as those shown in Snyder.

Still further, the invention comprehends the use of a bearing structure that surrounds the entire pump casing. This affords a very stable and positively guided screw casing.

DESCRIPTION OF THE PREFERRED EMBODIMENT

Figure 1:
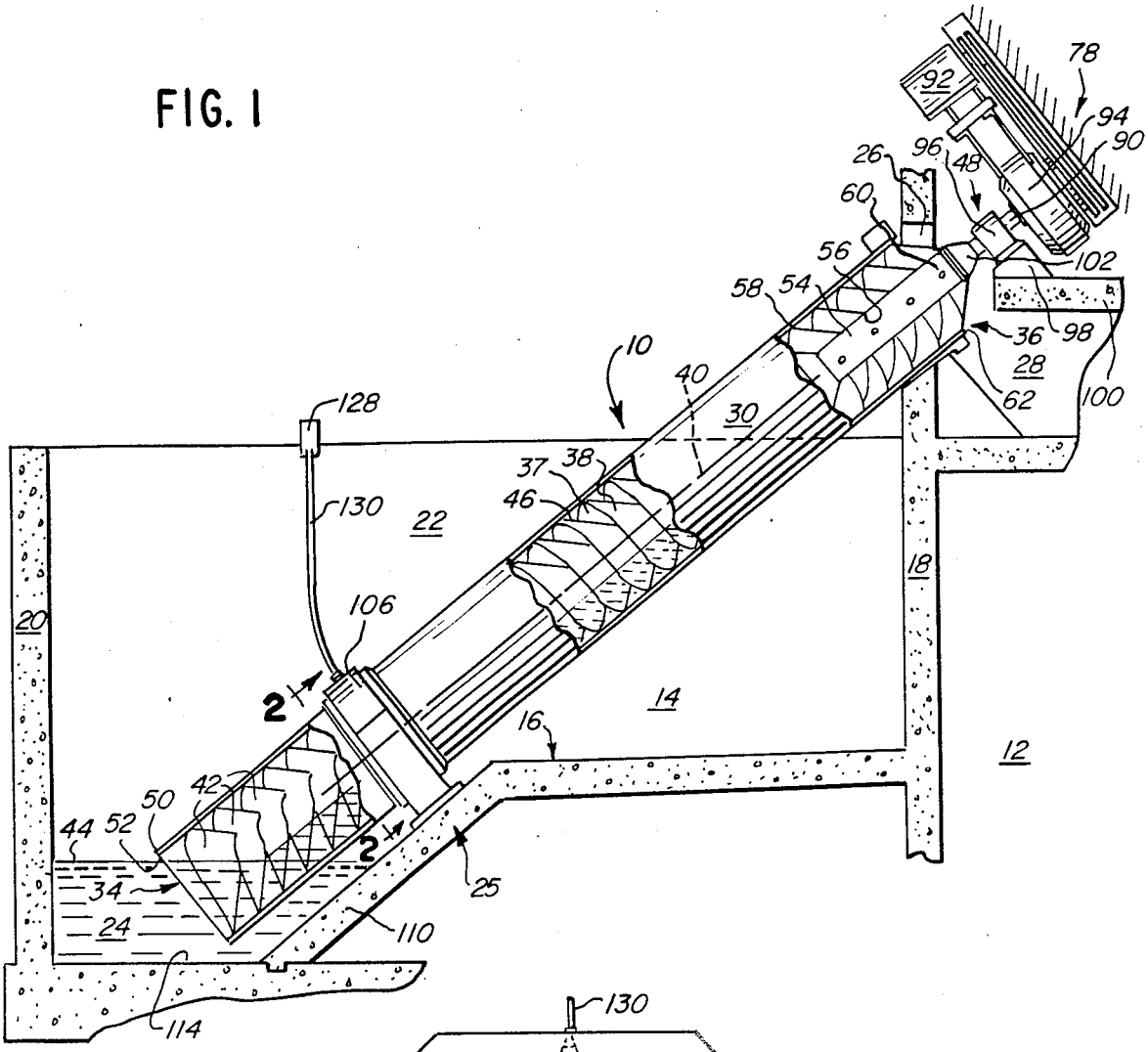
FIG. 1 is a side elevation view of a screw pump according to the present invention located in a fluid reservoir and with a screw casing thereon partially broken away.
Figure 2:
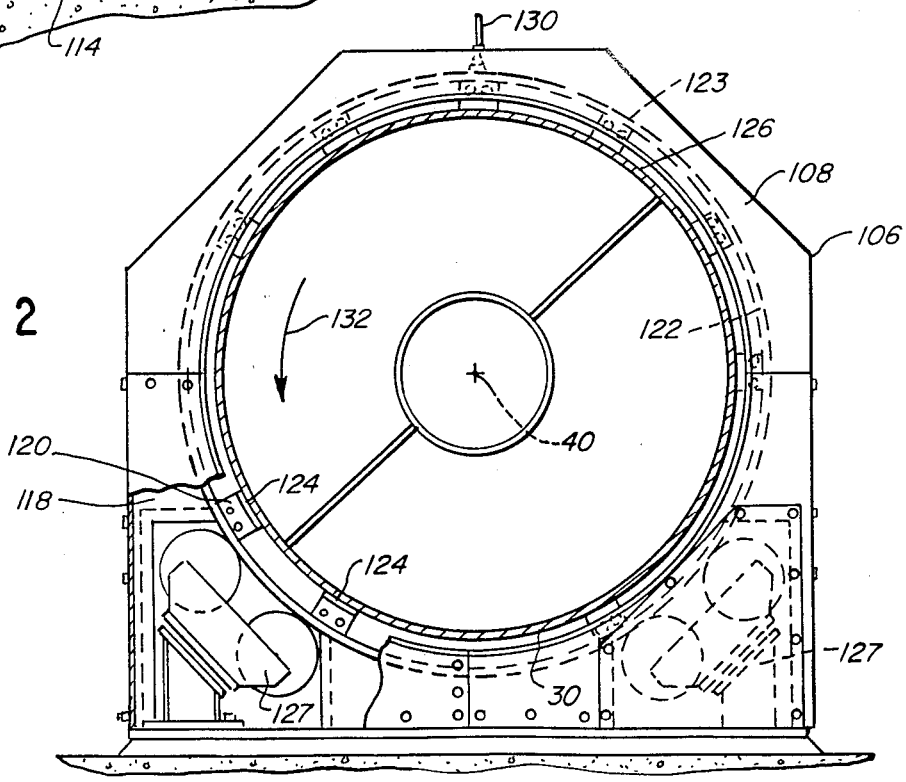
FIG. 2 is a sectional view of the pump casing and screw taken along line 2—2 of FIG. 1 and showing a bearing assembly for the casing.

In FIG. 1, a preferred form of a rotary screw pump according to the present invention is shown at 10 and mounted in a poured concrete vessel 12, defining a dry pump pit 14, as commonly used in water treatment facilities. The vessel 12 has a stepped bottom wall 16, spaced end walls 18, 20, and spaced side walls 22 (one shown). Water in a wet well 24 in the pump pit 14 below a lower bearing mount 25 for the screw pump 10 is hoisted by the screw pump 10 and delivered through an opening 26 in the end wall 18 into a collecting outlet 28.

The screw pump 10, as seen in FIGS. 1–5, consists of a cylindrical casing 30 having an inside surface 32 defining a fluid flow space. The axial ends of the casing 30 are open to define a fluid inlet 34 and fluid outlet 36. Within the casing 30 are intermeshed hoisting screws 37, 38, both wound continuously between the casing inlet and outlet ends 34, 36, respectively, and fixed and sealed to the inside surface 32 of the casing 30.

In operation, the inlet end 34 of the casing 30 is dipped into the supply 24 and the screws 37, 38 and casing 30 are rotated as a unit about the cylindrical axis 40 of the casing 30. Water from the supply 24 is elevated up the screw flights 42 until it reaches the outlet 36, at which point it spills out of the casing 30 into the reservoir 28. The action of the pump 10 can be likened to that of a continuously moving bucket.

The screw pump 10, which as seen in FIG. 1 is shown inclined at approximately 45°, could be inclined at any other angle, and the pitch angle of the flights 42 is selected in connection therewith to maximize lifting capacity. The screws 37,38 are coreless preferably along the bottom two thirds of their length. Pockets 46 are defined between adjacent screw flights 42. In operation, water is conveyed in the flow space in the pockets 46 only below the hollow core of the screws 37,38, as shown in FIG. 1.

The casing 30 is supported for rotation by the mount 25 and a second mount 48, spaced axially from mount 25. The mounts 25, 48 will be described in greater detail hereafter. The casing length is chosen so that with the supply 24 at its maximum anticipated height, the water does not seal the bottom edge 50 of the casing 30 at the inlet end 34. Thus a slight air space 52 is preferably maintained between the upper level 44 of the supply 24 and the casing edge 50.

If the air space 52 is minimal or if the inlet end 34 of the casing 30 is entirely submerged in a conventional pump, the screw flights 42 would tend to evacuate the pockets 46 between the flights 42 above the water level 44. As this occurs, the pump 10 would cavitate, resulting in substantially diminished pump capacity. Backflow of water from the upper flights 42 could also occur.

One objective of the present invention is to break the vacuum in the pockets 46 and to thereby maximize pump capacity. To accomplish this, an elongate conduit/torque tube 54 extends through the screws 37, 38 in alignment with the casing 30. The inside flight edges 56 are suitably secured to the conduit/torque tube 54, as by welding. The outer edges 58 of the flights 42 closely mate with the inside surface 32 of the casing 30 and are suitably secured and sealed thereto to define a unitary structure consisting of the casing 30, screws 37, 38 and conduit/torque tube 54.

Figure 3:
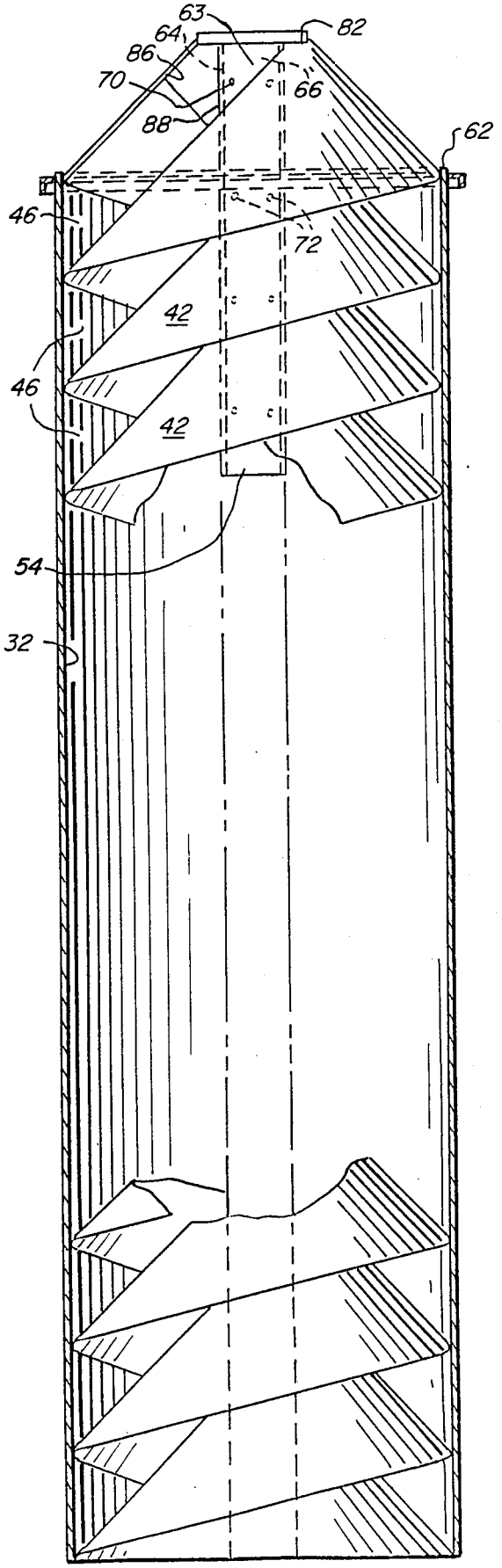
FIG. 3 is an enlarged, lengthwise, sectional view of the pump casing and screw.

The conduit/torque tube 54 preferably extends over no more than one half the screw length at the outlet ends of the screws 37, 38 and, in FIG. 1, extends along approximately one-sixth of the screw length, while in FIG. 3 the conduit/torque tube 54 extends over approximately one third of the screw length. The structure in FIG. 3 is otherwise the same as that shown in FIG. 1. The outlet end 60 of the conduit/torque tube 54 extends axially beyond the free edge 62 of the casing 30 at the outlet 36 so that an end 63 of the conduit 54 is exposed to the atmosphere. The conduit/torque tube 54 is tubular and has an internal, cylindrical surface 64 defining a vent path 66. One or more apertures 70 extend radially through the exposed end 63 to establish communication between the atmosphere and the vent path 66 within the conduit/torque tube 54.

The apertures 72 are provided in the conduit/torque tube 54 in coincidence with each pocket 46 defined by the flights 42 over the conduit/torque tube length. In the embodiment shown, the conduit/torque tube 54 intersects four separate pockets 46 and has four aperture pairs in communication with the pockets 46. The remainder of the pockets 46 are in communication with each other and the vent path 66 defined by the conduit/torque tube 54 through the hollow screw core below the conduit/torque tube 54. A vent path is established between the pockets 46 and atmosphere through the hollow screw core, the apertures 72, the vent path 66 and aperture 70. Because the end 63 is directly exposed to the atmosphere, no opening need be provided in the screw flights 42.

It has been found that the vent path defined by the conduit/torque tube 54 effectively breaks the vacuum that tends to be created in the air spaces 46 between screw flights 42.

Figure 4:
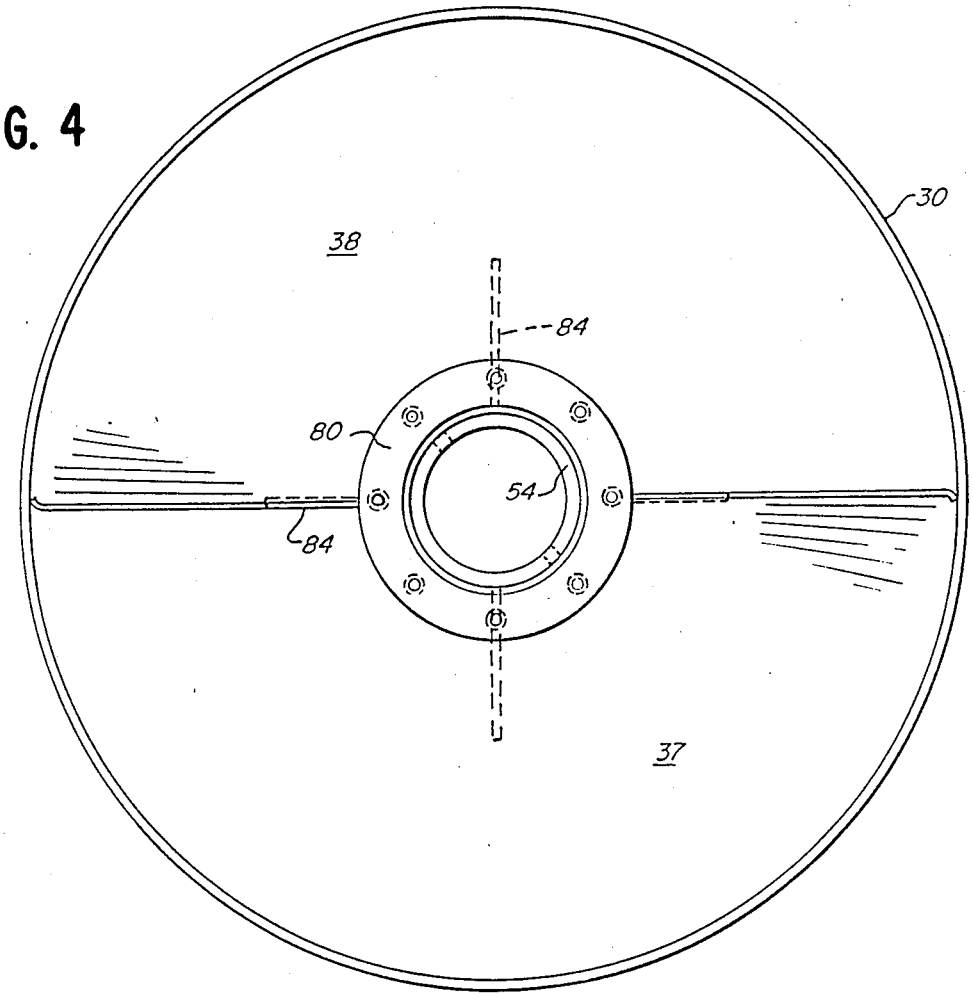
FIG. 4 is an enlarged, end view of the pump casing and screw.
Figure 5:
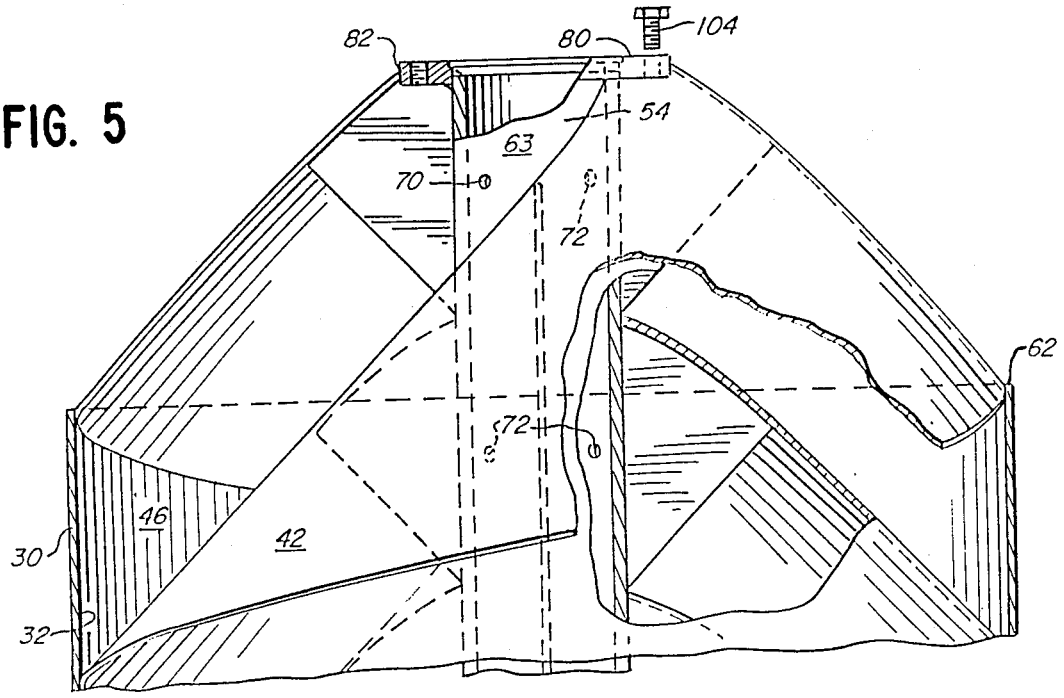
FIG. 5 is an enlarged, fragmentary, sectional view of the outlet end of the pump casing and screw.

The invention also comprehends that the conduit/torque tube 54 transmit the torque from a rotary drive 78 to the screws 37,38. The drive in FIG. 4 is belt operated, however any other type of rotary drive could be used. As seen in FIG. 4, a disk-shaped mounting plate 80 is secured as by welding to the upper, free edges 82 of the screws 37, 38. Reinforcing gusset plates 84 are welded between the inside surface 86 of the flights 42 and the peripheral surface 88 of the conduit/torque tube 54.

The drive unit 78 has a drive shaft 90 rotatably driven by a motor 92 through a conventional speed reduction mechanism 94. The shaft 90 is journalled for rotation in a bearing 96, defining mount 48, and carried on a pad 98 on a horizontally disposed wall 100 of the vessel 12. The bearing 96 is of a conventional construction and details of the same need not be explained. The shaft 90 carries a reinforced mounting bracket 102, which is fixedly secured to the mounting plate 80 by bolts 104 (one shown in FIG. 5).

The casing 30 is supported for rotation at a location remote from the bearing 96 by a ring and bearing assembly 106 defining the mount 25. The ring and bearing assembly 106 has a housing 108, which is supported on an inclined section 110 of the vessel bottom wall 16. The housing 108 has an internal chamber 118 (FIG. 2) and a plurality of bearing pads 120 therein spaced peripherally about an opening 122 defined by the housing 108 and through which the screw casing 30 extends. The bearing pads 120 are carried on a forged ring 123 and have surfaces 124 conforming to the outer surface 126 of the screw casing 30 to cooperatively support the casing 30 in the housing 108. The ring 123 is supported and guided in rotation by spaced roller assemblies 127. The ring and roller bearing assembly 106 is disposed on forged ring 123 and may be replenished through an oil reservoir 128 and a conduit 130. Because the ring and roller bearing assembly 106 surrounds the entire casing 30, the casing 30 is positively supported and guided relative to the frame 12 for rotation in the direction of arrow 132 in FIG. 2.

The conduit/torque tube 54 serves the dual purpose of establishing a pressure equalizing vent path and serves as a drive extending between the rotary drive 78 and the rotatable components including the casing 30 and the screws 37,38. Because the conduit/torque tube 54 extends over no more than one-half the length of the screws 37,38, incorporation of the conduit 54 into the overall structure is relatively simple from a manufacturing standpoint. At the same time, the conduit 54 has a surface exposed directly to the atmosphere so that the establishment of communication between the atmosphere and the vent path 66 within the conduit 54 is facilitated without altering the flights 42.

I claim:

1. A screw-type fluid pump comprising:

an elongate casing having a surface defining an internal fluid flow space, a fluid inlet and a fluid outlet above the fluid inlet;

a fluid advancing screw having a rotational axis, a plurality of flights, and a central hollow core extending through the flights, and a central hollow core extending through the flights between the fluid inlet and the fluid outlet;

means mounting the screw fixedly to the casing in the fluid flow space so that the screw and casing can be rotated as a unit about an axis to convey fluid introduced at the inlet over the flights axially towards the outlet, there being a plurality of axially spaced pockets between adjacent screw flights within the fluid flow space;

a conduit having a length no more than one third the axial extent of the screw;

means for mounting the conduit within the hollow core to the screw; and means for connecting the conduit to a rotary drive so that the conduit, fluid advancing screw and casing can be rotated to raise a fluid from the casing inlet to the casing outlet, said conduit having a wall bounding a hollow space, a first surface in direct radial exposure to the atmosphere and a second surface exposed to one of the pockets, there further being first and second discrete apertures through the conduit wall with one of the first and second apertures extending through the first surface of the conduit and defining a communication path between the atmosphere and the hollow space and the other of the first and second apertures extending through the second surface of the conduit and defining a communication path between the hollow space and the one of the pockets, whereby the conduit serves the dual purpose of transmitting a rotary drive force to the advancing screw and vents the one of the pockets to the atmosphere to prevent the development of vacuum therein.

2. The fluid pump according to claim 1 wherein there is a third aperture extending through the conduit, said second and third apertures communicate between the vent path and a first and second of the plurality of pockets, the first, second and third apertures extend radially through the conduit wall and there are fourth, fifth and sixth apertures extending radially through the conduit wall consecutively in substantially axial alignment with and circumferentially spaced from the first, second and third apertures.

3. The fluid pump according to claim 1 wherein the casing surface is substantially cylindrical and the conduit is coaxial with the casing surface.

4. The fluid pump according to claim 1 wherein said screw has axially spaced inlet and outlet ends and the conduit is in axially overlapping relationship over approximately one third of the axial extent of the screw at the outlet end thereof.

5. A screw-type fluid pump comprising:

a casing having a cylindrical surface defining an internal fluid flow space with axially spaced inlet and outlet ends;

a fluid advancing screw having an inlet end, an outlet end and a plurality of flights defining a central hollow core extending axially the entire length of the screw;

means mounting the screw fixedly to the casing in the fluid flow space so that the screw and casing can be rotated as a unit about the axis of the casing surface to convey fluid at the inlet along the axis of the casing surface on the screw flights between the casing inlet and outlet, there being a plurality of pockets defined between axially adjacent flights;

a conduit;

means for mounting the conduit to the fluid advancing screw at least partially within said fluid flow path, said conduit having a surface defining a vent path in communication with the hollow core, said surface of the conduit and vent path defined thereby extending axially above the outlet end of the casing with the surface of the conduit being exposed to the atmosphere;

first means communicating between the vent path and at least one of the pockets;

means for connecting the conduit to a rotary drive so that a drive force from the rotary drive is imparted to the screw and in turn the casing through the conduit; and second means separate from said first means for communicating radially between the vent path and the atmosphere through a portion of the exposed surface of the conduit extending axially beyond the outlet end of the casing, whereby the conduit serves the dual purpose of transmitting a rotary drive force to the advancing screw and vents the one of the pockets to the atmosphere to prevent the development of vacuum therein.

6. The screw-type fluid pump of claim 5 wherein bearing means surround the casing to mount the casing for rotation relative to a fixed pump support.

* * * * *